United States Patent [19]

Hampton

[11] 3,951,343

[45] Apr. 20, 1976

[54] FUEL OIL NOZZLE

[76] Inventor: William J. Hampton, 217 Suzanne, Taft, Calif. 93268

[22] Filed: Aug. 9, 1974

[21] Appl. No.: 496,075

[52] U.S. Cl. ..... 239/399; 239/432

[51] Int. Cl.[2] ..... B05B 1/34

[58] Field of Search ..... 239/399, 8, 427, 427.3, 239/433, 493, 400, 401, 432, 402

[56] References Cited

UNITED STATES PATENTS

| | | | |
|---|---|---|---|
| 1,087,768 | 2/1914 | Hoffman | 239/402 |
| 1,554,788 | 9/1925 | Corwin | 239/417 |
| 1,587,249 | 6/1926 | Starr | 239/427 X |
| 2,249,482 | 7/1941 | Macchi | 239/493 X |
| 2,514,581 | 7/1950 | Janssen | 239/399 X |
| 2,543,617 | 2/1951 | Wiant | 239/401 |
| 2,914,257 | 11/1959 | Wiant | 239/399 X |

*Primary Examiner*—John J. Love

*Attorney, Agent, or Firm*—Huebner & Worrel

[57] ABSTRACT

An atomizing fuel oil nozzle having a plurality of oil and gas mixing chambers in which the entry of the gas creates a suction that enhances the atomization of the oil and a flow chamber downstream of the mixing chambers through which the atomized mixture passes before being discharged through an orifice.

A method of mixing and atomizing fuel oil with a gas wherein the gas has a substantially higher pressure and velocity than the oil in the mixing chamber, the flow of the gas creating a substantial suction in the mixing chamber from which the gas and oil mixture pass through a flow chamber before being discharged through the nozzle orifice.

7 Claims, 4 Drawing Figures

FUEL OIL NOZZLE

BACKGROUND OF THE INVENTION

The invention relates to fuel oil nozzles used in boilers or steam generators in which oil is burned to heat water to form steam. More particularly, the present invention is a fuel oil nozzle wherein a gas atomizes the oil and the method of atomizing the oil with a gas for high efficiency burning and for reducing the polluting affluent gases from the burning.

Prior art U.S. Pat. Nos. 1,517,496; 1,560,025; 2,514,581; 3,100,084; 3,232,536 and 3,456,933 are known to applicant.

In the prior art, compressed air, natural gas and steam have been used in fuel oil nozzles to atomize the fuel oil. Steam has the disadvantage of providing moisture and a cooling effect but it is the most practical of the three gases because it is the least expensive and it is usually more easily available. The prior art atomizing nozzles generally require the steam to be of a larger volume than the fuel oil and of about the same pressure as the fuel oil and this results in a high volume of steam having a cooling effect on the burning oil so as to reduce the efficiency and results in a large volume of affluent discharge gases that cause air pollution.

SUMMARY OF THE INVENTION

The invention is in the method of the mixing of the oil and gas and in the structure of the fuel oil nozzle, including the configuration of the mixing chambers into which are discharged the fuel oil and atomizing gas, the gas and oil inlets being arranged so that the gas flow creates a suction within the mixing chamber and causes greater and more effective atomization of the oil than was heretofore obtained.

Therefore, it is an object of the present invention to provide an improved atomizing fuel oil nozzle and an improved method of creating an atomized mixture of fuel oil and a gas to provide a more efficient oil burning.

It is another object of the invention to provide a fuel oil nozzle and method of mixing fuel oil with an atomizing gas in which a very substantial increase in the gas pressure and velocity and reduction in the gas volume are achieved. An increase of gas pressure and velocity and a reduction of gas volume are economic benefits in the uses of all appropriate gases but are particularly important in the use of the more practical gas, steam. The use of steam itself is an economic advantage, but the use of less steam, according to the invention, is of even greater benefit due to the decrease in the moisture and cooling effect of the steam and of the cost thereof.

In the present invention the fuel oil nozzles are used in steam generators adjacent oil wells of the type in which the oil is very viscous and the produced steam is injected into the oil sands to heat the oil so that there is a very substantial increase in the oil production. In such use of the present invention is steam generators, in one installation it was found that the steam produced to the fuel oil burned ratio has been increased 6.1%. In another installation employing the present invention, using the produced steam for injecting into oil wells, using oil at the price of $3.75 per barrel, it was found that the oil costs would be reduced in the amount of $280.50 per month in 22 million B.T.U. per hour generators and $1,009.80 per month in 50 million B.T.U. per hour generators.

In the 22 million B.T.U. per hour steam generators, it was found that affluent polluting gases were reduced by the present invention in the amount of 570 lbs. per day and in the 50 million B.T.U. per hour steam generators, using the present invention, the affluent polluting gases were reduced in the amount of 2,700 lbs. per day. These reductions in polluting gases were of the order of about 50%.

In the present invention in which the steam and oil passages are shown to have about the same diameter, the steam pressure may be from 15% to 45% greater than the pressure of the oil. The higher steam pressure reduces the steam volume from 75% to 85% of the prior art volume where the oil and steam pressure were equal and this lower volume substantially reduces the cooling effect of the steam in the atomized oil. The accompanying increase in steam velocity increases the suction in the mixing chambers and greatly increases the atomization of the oil.

Nozzles according to the present invention may also be used in steam producers for drying rock for hot batch plants and in heat tempering and blast furnaces.

Further objects and advantages of the invention may be brought out in the following part of the specification wherein small details have been described for the competence of disclousre, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENTS

Figure 2:
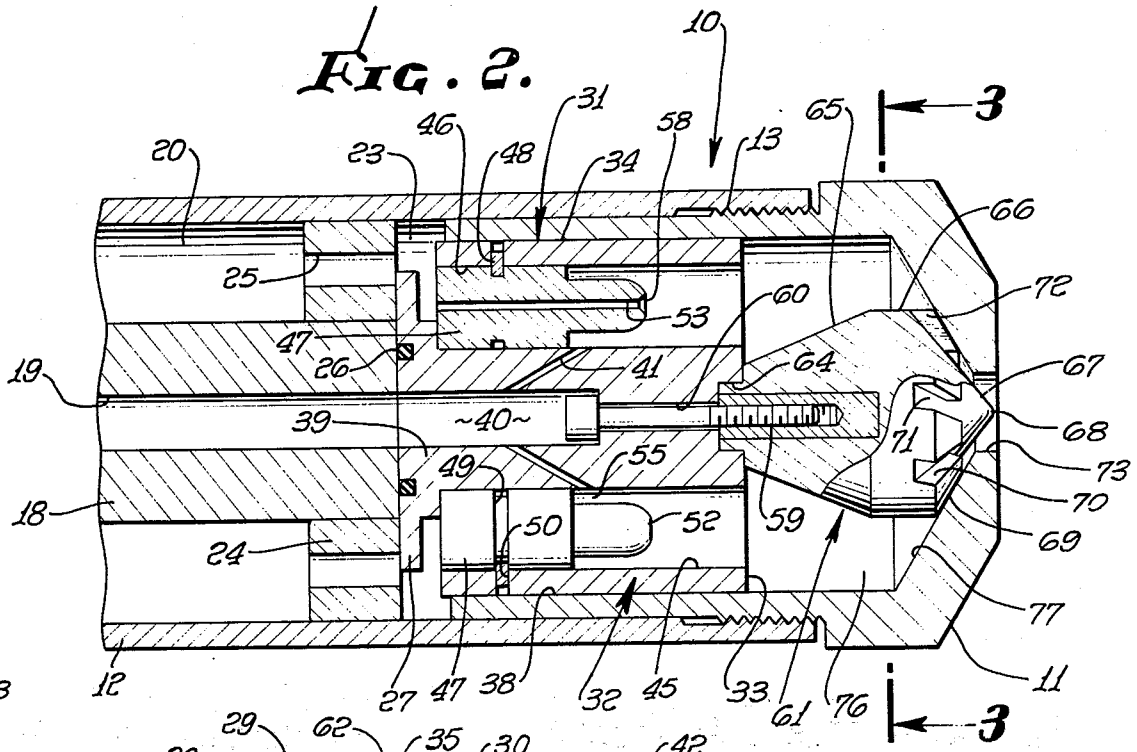
FIG. 2 is an elevational cross-sectional view of the portion shown in FIG. 1 enclosed within its cap.
Figure 1:
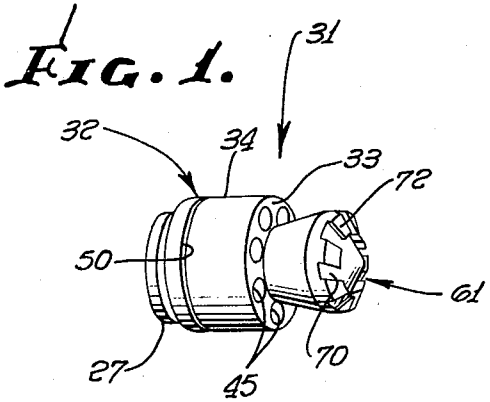
FIG. 1 is a perspective view of the internal nozzle portion of the invention.

Referring again to the drawings, there is shown in FIG. 1 an atomizing nozzle, generally designated as 10, having at its discharge end a cap 11, as shown in FIG. 2, threadedly engaged at 13 to a fuel oil and atomizing gas supply pipe 12. The supply pipe is comprised of a concentrically positioned inner pipe 18 having an oil supply line 19, the pipes 12 and 18 forming an annulus 20, through which the atomizing gas flows. Secured between the inner pipe 18 and the outer pipe 12 at the inner end of the former is annular plug 24 having a plurality of gas inlets 25 through which the gas flows to the nozzle 10.

The tightening of the pipe 12 on the cap 11 moves pipe 18 into sealing engagement on the o-ring 26 positioned in an annular groove in an annular end flange 27 of the internal nozzle structure, generally designated as 31. The flange 27 forms a base of the nozzle body, generally designated as 32, the body extending from the flange 27 to an upper annular surface 33. The body 32 has an outer cylindrical surface 34 which is slidably engaged but closely fitted within cylindrical surface 38 on the interior of the cap 11.

Figure 3:
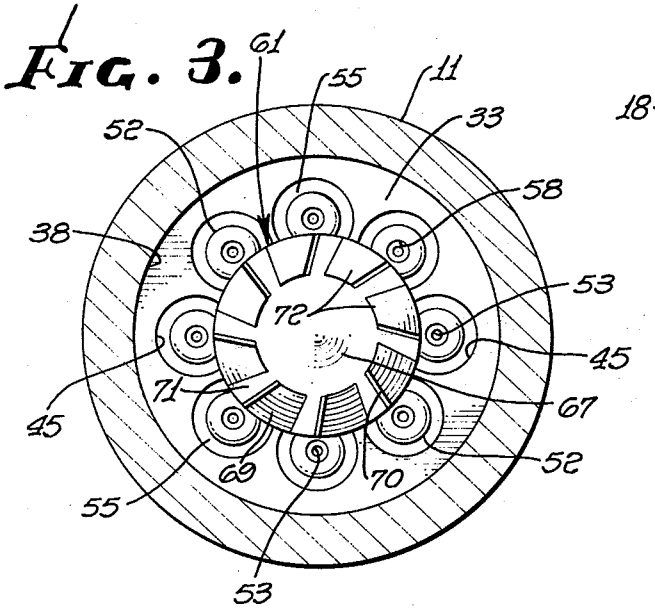
FIG. 3 is a cross-sectional plan view, taken generally along the lines 3—3 of FIG. 2.

Within the body 32 is a central portion 39 having a main nozzle oil inlet 40 in communication with the oil supply line 19 and connected to the inlet 40 are eight annularly spaced small diameter oil passages 41. As shown in FIGS. 2 and 3, each oil passage 41 is connected to one of eight cylindrical, annularly spaced mixing chambers 45. The number of mixing chambers and connecting passages are a matter of design. Fitted into the body 32 upstream of or below the mixing chambers 45 in cylindrical portions 46 are eight gas passage plugs 47, held in place within the body 32 by a snap ring 48 within an annular groove 50 in the body and an annular groove 49 in each plug 47.

The cylindrical plugs 47 have an upwardly extending generally cylindrical tube portion 52, each spaced from a respective cylindrical wall of the mixing chambers 45. Extending through the plugs 47 and the tubular portions 52 are gas passages 53, each being in communication with the gas inlets 25, an annular space 23, formed between the body and the cap wall, and at flared, jet discharge ends 58 with the respective mixing chambers 45. The oil passages 41 are in communication with the mixing chambers within and adjacent the bases of the annuluses 55, formed between the tubes 52 and the walls of the mixing chambers, upstream of the jet discharges 58 of the gas passages 53. The oil passages 41 and the gas passages 53 have about equal small diameters. In one embodiment of the invention, the diameters of oil and gas passages are 0.082 inch.

At the upper end of the main oil inlet 40, there is an Allen screw 59 extending through a bore 60, the screw being threadedly engaged in a protruding member, generally designated as 61. The member 61 is fitted into a counter bore 64 in the upper end of the central portion 39 and is secured thereto by the screw 59. Member 61 has an upwardly enlarging conical surface 65, terminating in a cylindrical portion 66. The conical surface 65 extends over the mixing chambers a distance less than half their diameter so that some of the flow therefrom impinges on the conical surface.

Cut into the cylindrical surface 66 are grooves 70 having a conical surface 71, continuous with a conical surface 67, extending beyond the grooves and terminating in a point 68. Spaced between the grooves are lands 72, the outer surfaces 69 of the lands being conical and parallel to the conical surface 67. The lands and grooves are generally spirally directed. The point 68 extends into a discharge orifice 73 in the top of the cap 11.

Surrounding the conical surface 65 and the cylindrical surface 66 is a generally annular flow chamber 76 having outer walls 38 and 77, the latter being an interior conical surface of the cap and being complementary to the conical land surfaces 69 on which they fit. Flow chamber 76 is in communication with the mixing chambers and with orifice 73 by means of grooves 70.

Figure 4:
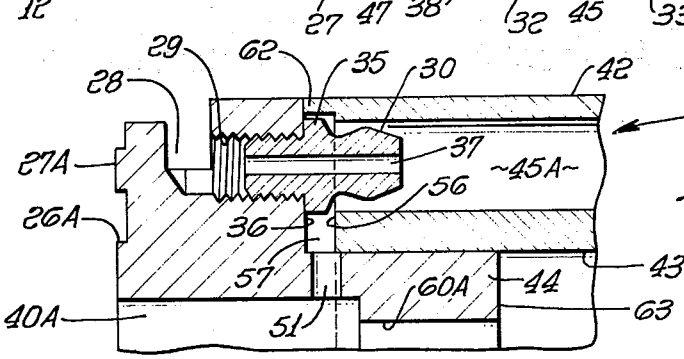
FIG. 4 is a fragmentary cross-sectional view of another embodiment of the invention.

In FIG. 4 another embodiment of the invention is illustrated. The nozzle body shown in FIG. 4, generally designated as 32A, may be substituted for the nozzle body 32 shown in FIG. 2. The body 32A has an annular flanged base member 27A, having an annular seal groove 26A to receive a ring seal for fitting against the pipe 18. When so fitted, the oil supply line 19 is aligned with oil inlet 40A.

Similarly, the gas inlets 25 are positioned to supply gas around the circumference of the base member 27A and into an annular groove 28 which is in communication with a plurality of annularly spaced threaded bores 29 in the base member, the actual number being eight in the embodiment shown. In each bore 29 there is threadedly engaged a tubular member 30 in the form of a jet nozzle or fitting. Each member 30 has a hexagonal-nut flange 35 in abutment with an annular surface 36 of the base member and has a tubular gas passage 37 which permits the gas to flow from the gas inlets 25 to eight cylindrical, annularly spaced mixing chambers 45A.

The mixing chambers are formed within a cylindrical member 42 around a cylindrical central bore 43. The bore 43 is fitted on a centrally positioned cylindrical boss 44 extending outwardly from the annular surface 36 of the base member. The boss 44 has a central bore 60A in alignment with the main oil inlet 40A. Eight radially directed bores 51 extend from the outer surface of the boss 44 to the main oil inlet 40A. Each bore 51 is in radial alignment with one of the eight tubular members 30. The annular surface 36 and an annular surface 56 extending around the mixing chamber openings on the cylindrical member 42 form an annular oil passage 57 which is in communication with each of the passages 51 and each of the mixing chambers 45A. The passage 57 is closed by an axially directed, circumferential flange 62 on the wall of the cylindrical member 42 and being in abutment with the outer circumferential edge of the surface 36.

Each of the tubular members 30 is annularly spaced from the walls of the mixing chambers 45A in a manner similar to the arrangement of the tubular members 52 and the walls of the mixing chambers 45 in FIG. 2, except that the members 30 have an enlarged diameter portion which reduces the annular space between them and the chamber walls. In this embodiment the oil is permitted to enter the mixing chamber upstream of the discharge ends of the gas passages 37 in a manner similar to the arrangement shown in FIG. 2 so as to develop a proper suction, according to the invention, of the oil by the gas flow into the mixing chambers, the gas discharge being downstream of the oil discharge a distance at least approximately equal to the diameter of the oil passage but preferably greater as shown.

The remainder of the internal nozzle structure shown in FIG. 4 is the equivalent of that shown in FIG. 2. In the embodiment in FIG. 4 the protruding member 61 has a relatively long boss compared with that in the counterbore 64 in FIG. 2, and it is fitted into the bore 43 and in abutment with the annular surface 63 of the boss 44. An Allen headed bolt fitted in the passage 60A secures the protruding member in FIG. 4 to the nozzle body and holds the nozzle body members together. Thus, the protruding member, as it is fitted on the nozzle body in FIG. 4, is positioned so as to be equivalent to the arrangement in FIG. 2 whereby the mixed oil and gas flows out of the mixing chambers into a flow chamber 76.

In operation, using alternative reference numerals to describe the operation of both embodiments, the oil and atomizing gas are flowed into the nozzle simultaneously. The gas flows through the pipe annulus 20, the inlets 25, the annular spaces 23 or 28, the gas passages 53 or 37 and into the mixing chambers. The oil flows through the supply line 19, the main inlet 40 or 40A, the oil passages 41 or 51, 57, and into the mixing chamber annuluses upstream of the gas discharges. From the mixing chambers, the gas and oil mixture flows into the annular flow chamber 76, through the grooves 70 and out through the orifice 73 into the burning area.

The oil pressure may be approximately 60 lbs. per square inch, for example, and according to the invention, the steam may have from 15% to 45% greater pressure than the oil and this reduces the steam volume from 75% to 85% of what it would be if the gas were at the lower oil pressure. This increase in pressure and the reduction in volume are accompanied by an increase in gas velocity so as to create a very substantial jet venturi suction effect within the mixing chambers 45 to cause the oil entering these chambers to be sucked into and mixed with the gas stream and to be finely atomized. The higher gas pressure, the lower gas volume and the higher gas velocity provide a method of atomization that substantially reduces the fuel oil particle size so as to expose more oil surface area for more nearly complete combustion. The entry of the oil at the upstream end of the annuluses 55 of the mixing chambers provides additional mixing-flow for the oil to further enhance its atomization.

When the gas is steam, its lower volume provides the additional advantages of less cooling and less moisture so as to improve the oil combustion. Further, the reduction in the steam volume permits more of the generator produced steam to be delivered to its ultimate use, for example, the oil sands.

The invention and its attendant advantages will be understood from the foregoing description and it will be apparent that various changes may be made in the form, construction and arrangement of the parts of the invention without departing from the spirit and scope thereof or sacrificing its material advantages, the arrangements hereinbefore described being merely by way of example. I do not wish to be restricted to the specific forms or uses mentioned except as defined in the accompanying claims, wherein various portions have been separated for clarity of reading and not for emphasis.

I claim:

1. An atomizing fuel oil nozzle comprising:

a body having a main oil inlet and at least one gas inlet;

at least one mixing chamber in said body;

at least one oil passage in said body, each oil passage connecting the oil inlet with a mixing chamber for oil discharge therein;

at least one gas passage in said body, each gas passage connecting a gas inlet with a respective mixing chamber for gas discharge therein;

each gas passage being formed within a tube at its discharge end, each tube extending into the respective mixing chamber and being spaced from the walls thereof;

each oil passage being in communication with a mixing chamber upstream from the gas tube discharge end;

a protruding member on said body downstream of the mixing chamber and having a surface extending over the mixing chamber;

an outer discharge end on said protruding member terminating in a pointed conical surface having lands and grooves;

a cap on the discharge end of the nozzle and having a discharge orifice fitted in alignment with the point on the conical surface, said grooves being in communication with said orifice, an inner surface of the cap around said orifice being conical for fitting on said lands; and a gas and oil mixture flow chamber formed by said surface extending over the mixing chamber and a wall of said cap, said flow chamber being in communication with said grooves so that said mixture will discharge through said orifice.

2. An atomizing fuel oil nozzle comprising:

a body having a main oil inlet and at least one gas inlet;

a plurality of mixing chambers in said body;

a plurality of oil passages in said body, each oil passage connecting the oil inlet with a respective mixing chamber for oil discharge therein;

a plurality of gas passages in said body, each gas passage connecting a gas inlet with a respective mixing chamber for gas discharge therein;

each gas passage being formed within a tube at its discharge end, each tube extending into the respective mixing chamber and being spaced from the walls thereof;

each oil passage being in communication with a respective mixing chamber upstream from the gas tube discharge end;

a protruding member on said body downstream of the mixing chambers and having a surface extending beyond the mixing chambers;

an outer discharge end on said protruding member terminating in a conical surface having lands and grooves;

a cap on the discharge end of the nozzle having a discharge orifice and being fitted over the conical surface, said grooves being in communication with said orifice;

an inner surface of the cap around said orifice being conical for fitting on said lands; and a gas and oil mixture flow chamber formed by said surface extending beyond the mixing chambers and a wall of said cap, said flow chamber being in communication with said grooves so that said mixture will discharge through said orifice.

3. An atomizing fuel oil nozzle according to claim 2 in which:

said mixing chambers are cylindrical having an open downstream end, each tube extending into its mixing chamber forming an annulus with the mixing chamber wall.

4. An atomizing fuel oil nozzle according to claim 3 in which:

said each oil passage is connected to a mixing chamber at an upstream end of said annulus.

5. An atomizing fuel oil nozzle according to claim 4 in which:

said mixing chambers are annularly spaced around their respective oil passages, said surface extending beyond the mixing chambers on said protruding member being conical and enlarging in the downstream direction and being spaced from said surface having lands and grooves by a cylindrical surface, and said surface enlarging in the downstream direction extending over each mixing chamber to an extent of less than one-half of its diameter so that a substantial portion of the mixture may flow through the flow chamber without directly flowing into the enlarging surface.

6. An atomizing fuel oil nozzle according to claim 5 in which:

said lands and grooves extend from said spacing cylindrical surface for less than half its diameter, said conical surface having lands and grooves being continuous with the surface of said grooves from said spacing cylinder to a conical point, said grooves being generally spiral in direction.

7. An atomizing fuel oil nozzle comprising:

a body having a main oil inlet and at least one gas inlet;

a plurality of cylindrical mixing chambers in said body each having an open downstream end;

a plurality of oil passages in said body, each oil passage connecting the oil inlet with a separate mixing chamber for oil discharge therein wherein said chambers are annularly spaced around their respective oil passages;

a plurality of gas passages in said body, each gas passage connecting a gas inlet with a separate mixing chamber for gas discharge therein;

each gas passage being formed within a tube at its discharge end, each tube extending into and having its discharge end a substantial distance downstream in its respective mixing chamber and being spaced from the walls thereof forming an annulus with said mixing chamber wall;

each oil passage being in communication with its respective mixing chamber adjacent the upstream end thereof and upstream from the respective gas tube discharge end;

each tube having an enlarged external diameter portion upstream of the gas discharge and downstream of the oil entry into the mixing chamber so as to reduce the width of the annulus between the tube and the mixing chamber wall at said enlarged diameter;

whereby the oil flows a substantial distance into the respective mixing chambers before it mixes with the gas and is restricted during said flow by said reduced width of the annulus.

* * * * *